US005725461A

United States Patent [19]

Bogard, II

[11] Patent Number: 5,725,461

[45] Date of Patent: Mar. 10, 1998

[54] WEIGHT LIFTING APPARATUS

[76] Inventor: Wayne M. Bogard, II. 1105 Markham St., Flint, Mich. 48507

[21] Appl. No.: 601,288

[22] Filed: Feb. 16, 1996

[51] Int. Cl.[6] ..... A63B 21/075

[52] U.S. Cl. ..... 482/106; 482/139

[58] Field of Search ..... 482/92–94, 104–108, 482/139, 148, 133–138; 224/265, 266; D21/195–197

[56] References Cited

U.S. PATENT DOCUMENTS

| | | | |
|---|---|---|---|
| 3,322,425 | 5/1967 | Moore | 482/105 |
| 3,370,850 | 2/1968 | Moore . | |
| 3,679,107 | 7/1972 | Perrine . | |
| 3,724,846 | 4/1973 | Perrine . | |
| 3,904,198 | 9/1975 | Jones . | |
| 4,018,442 | 4/1977 | Galler . | |
| 4,213,605 | 7/1980 | McPeak | 482/105 |
| 4,274,628 | 6/1981 | Hoagland . | |
| 4,455,020 | 6/1984 | Schnell . | |
| 4,650,186 | 3/1987 | McCreery et al. . | |
| 4,722,524 | 2/1988 | Waszkelewicz . | |
| 4,822,035 | 4/1989 | Jennings et al. | 482/106 |
| 4,836,535 | 6/1989 | Pearson . | |
| 4,863,158 | 9/1989 | Tassone . | |
| 4,865,314 | 9/1989 | Carter, Jr. . | |
| 4,944,509 | 7/1990 | Snider . | |
| 4,986,536 | 1/1991 | Zane . | |
| 5,058,886 | 10/1991 | Jackson . | |
| 5,211,615 | 5/1993 | Sides . | |
| 5,221,244 | 6/1993 | Doss . | |
| 5,248,287 | 9/1993 | Nicoletti | 482/106 |
| 5,312,314 | 5/1994 | Stephan et al. . | |
| 5,429,570 | 7/1995 | Beyer . | |

FOREIGN PATENT DOCUMENTS

| | | | |
|---|---|---|---|
| 1146068 | 3/1985 | U.S.S.R. | 482/106 |

*Primary Examiner*—Richard J. Apley
*Assistant Examiner*—John Mulcahy
*Attorney, Agent, or Firm*—Harness, Dickey & Pierce, P.L.C.

[57] ABSTRACT

An apparatus for weight training includes a frame, a pair of spaced-apart shoulder rests, a pair of spaced-apart and coaxial hand grips positioned between the shoulder rests and the frame, and a pair of spaced-apart and coaxial lateral bars for releasably receiving free weights. The pair of coaxial hand grips are preferably coaxially aligned with the pair of coaxial lateral bars. The user positions his head through a space centrally defined between the shoulder rests. The shoulder rests are positioned atop his shoulder before beginning his exercise routine.

11 Claims, 1 Drawing Sheet

WEIGHT LIFTING APPARATUS

BACKGROUND OF THE INVENTION

I. Field of the Invention

The present invention relates generally to equipment for weight lifting. More particularly, the present invention relates to a weight lifting apparatus used in a variety of ways, such use including toe lifts and deep knee bends.

II. Description of the Relevant Art

Exercise is generally divided into two forms of activity: Aerobic and anaerobic. In the former, oxygen is utilized by the body in such activities as running and bicycling, while in the latter oxygen is substantially excluded from the body's chemical processes in such activities as weight lifting. Modern physiology teaches that both forms of exercise are required to achieve optimum levels of physical fitness.

The activity of weight lifting or weight training has been a perennially popular sport. Weight lifting, for example, is a popular feature of world sporting events such as the Olympics. It is the primary anaerobic exercise.

There are two basic methods of weight training. One is through the use of weight machines which incorporate a variety of exercise activities into a single unit having no loose weights. Related to this group are weight benches. Examples of patents directed to this group include U.S. Pat. No. 4,650,186, issued Mar. 17, 1987, to McCreery et alia, U.S. Pat. No. 4,836,535, issued on Jun. 6, 1989, to Pearson, and U.S. Pat. No. 5,429,570, issued Jul. 4, 1995, to Beyer.

The other basic method of weight training is through the use of free weights and bar bell bars. In general, free weights incorporate a straight bar having disc-shaped weights which are removably attachable to both ends of the bar. The user operates free weights by lifting or curling the bar itself.

Free weights offer several advantages over weight machines. For example, free weights are relatively inexpensive and are easily (relatively speaking) moved and stored. Free weights also provide the user with considerable freedom of use, in that the weights themselves may be utilized in a variety of places.

There have been a variety of attempts made at improving free weights. For example, several shoulder-resting exercise devices have been developed. Examples of these are disclosed in U.S. Pat. No. 3,370,850 issued Feb. 27, 1968, to Moore, U.S. Pat. No. 3,679,107 issued Jul. 25, 1972, to Perrine, U.S. Pat. No. 4,274,628 issued Jun. 23, 1981, to Hoagland, U.S. Pat. No. 4,722,524 issued on Feb. 2, 1988, to Waszkelewicz, U.S. Pat. No. 4,865,314 issued on Sep. 12, 1989, to Carter, Jr., U.S. Pat. No. 4,986,536 issued Jan. 22, 1991, to Zane, and U.S. Pat. No. 5,211,61 5 issued May 18, 1993, to Sides.

Another group of improvements directed to free weights is related to modified exercise bars themselves. Examples of such inventions include U.S. Pat. No. 3,904,198 issued Sep. 9, 1975, to Jones, U.S. Pat. No. 5,221,244 issued Jun. 22, 1993, to Doss, and U.S. Pat. No. 5,31 2,314 issued May 17, 1994, to Stephan et alia.

Finally, a group of patents directed to the improvement of weight training devices includes those directed to modified accessories for bar bells, such as that shown in U.S. Pat. No. 4,455,020 issued Jun. 19, 1984, to Schnell.

While perhaps providing some improvement to the technology of weight training, the above-identified patents do not provide an answer to at least one of the areas of difficulty related to the use of free weights. Specifically, while the use of weights of lesser mass are relatively easy to manipulate by the weight lifter, difficulty arises when the weight lifter attempts to lift weights that are relatively heavy. This particular difficulty is related to operator safety. Danger arises where the operator is using the bar bell over his shoulders and is exercising with toe lifts or deep knee bends. Two problems generally arise from this technique. First, rather than resting on the user's shoulders, the bar itself often rests on the back of the user's neck and close to or on top of the user's back bone. The risk of physical damage from such a position is quite high. Secondly, there is the risk that the bar bell itself might roll from the user's back, also posing a serious potential risk to the user.

Accordingly, a method of allowing the user of a free weight to position the weight assembly on the user while maintaining a high degree of safety is wanting.

SUMMARY OF THE PRESENT INVENTION

It is therefore an object of the present invention to provide a free weight lifting bar which provides the user with a high degree of safety.

It is a further object of the present invention to provide such a bar which allows the user to position his head within a frame that defines part of the bar.

Still a further object of the bar of the present invention is to direct the weight directly to the top of the user's shoulders, thereby keeping the weight off of the user's back.

An additional object of the present invention is to provide such a bar that otherwise imitates the posture and grip ordinarily assumed by the weight lifter when using conventional free weight bars.

Yet an additional object of the present invention is to provide such a bar which is made up of a minimum number of parts and which is relatively easy to manufacture.

Still a further object of the bar of the present invention is to provide such an apparatus which allows the use of conventional weight discs.

The apparatus for weight training of the present invention includes a frame which defines a box-like peripheral structure comprising a pair of spaced-apart, parallel, and generally elongated front and back members connected by a pair of spaced-apart side members. A pair of spaced-apart shoulder rests also connect the front and back members together. The interior space defined by the shoulder rests and the front and back members is large enough so that the user's head may be passed therethrough.

A recessed area is defined on the underside of each of the shoulder rests for proper positioning of the rest on the user's shoulder. A pad may be fitted to the recessed area to enhance user comfort.

Perpendicular with the shoulder rests but parallel to the front and back members are a pair of coaxial hand grips which extend between the shoulder rests and the side members. The hand grips allow the apparatus to be grasped by the user. The grips are provided with a gripping surface defined by ridges or grooves formed either on the bars defining the hand grips or on plastic sleeves fitted around the bars.

Extending outwardly from the side members are a pair of coaxial, free-weight supporting lateral bars. A variety of weights are removably attachable to the lateral bars and are held in place by a releasable locking collar.

The foregoing and other objects, aspects and advantages of the present invention will be more fully appreciated by a reading of the following detailed description of the invention and its preferred embodiments.

BRIEF DESCRIPTION OF THE DRAWINGS

The various advantages of the present invention will become apparent to one skilled in the art upon reading the following specification and by reference to the following drawings in which.

DETAILED DESCRIPTION OF THE PREFERRED EMBODIMENT

The following discussion of the preferred embodiment of the present invention is merely exemplary in nature and is in no way intended to limit the invention or its application or uses.

Figure 1:
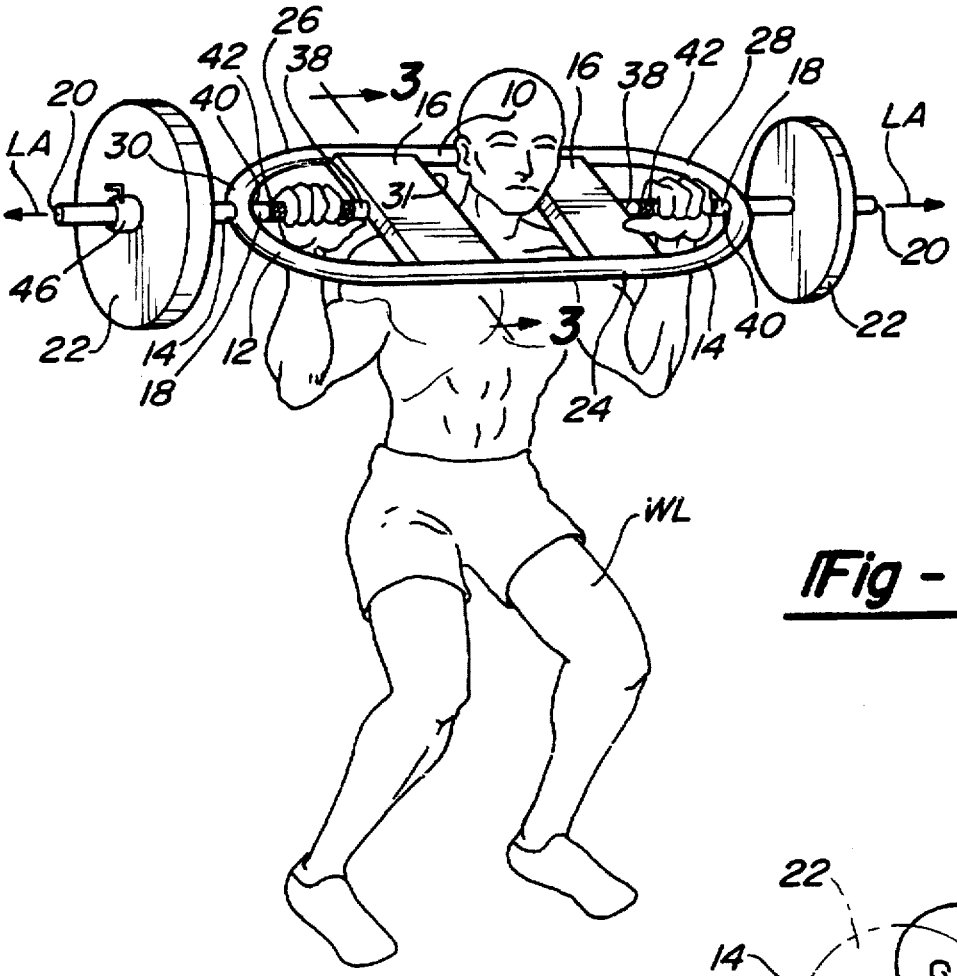
FIG. 1 is a perspective view of a weight lifter holding the weight lifting apparatus of the present invention.
Figure 2:
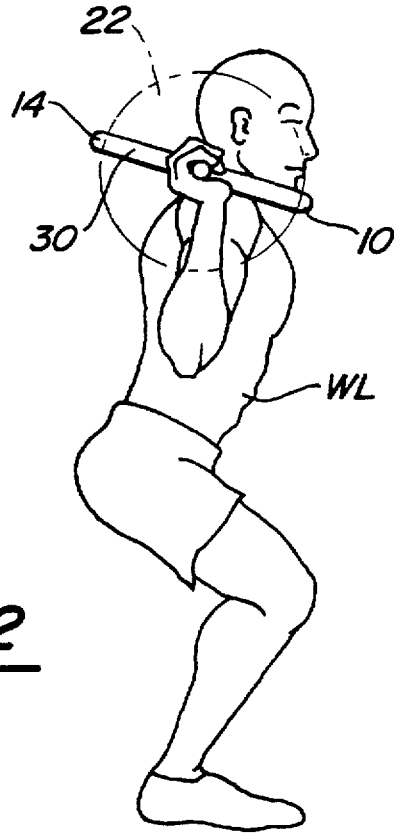
FIG. 2 is a side view of the weight lifter and weight lifting apparatus of FIG. 1.

Referring to FIGS. 1 and 2, a weight lifter, generally identified as "WL", is illustrated supporting a weight lifting apparatus 10 according to the present invention. As shown, the weight lifter's knees are slightly bent, a position that would be adopted during a deep knee bend. While particularly well-adapted for use during such an exercise, it is to be understood that the apparatus 10 may be used as well for other exercise procedures such as toe lifts.

The apparatus 10 includes a frame 12 which has a long axis indicated by arrows "LA". The frame 12 includes a peripheral structure 14, a pair of spaced-apart and parallel shoulder rests 16, a pair of spaced-apart and coaxial hand grips 18, and a pair of spaced-apart and coaxial free-weight supporting lateral bars 20.

Removably attached to the apparatus 10 are a variety of free weights 22. While the illustrated free weights 22 are conventional and are of a particular diameter and width, it is to be understood that the shape and general configuration of each of the illustrated free weights 22 is only exemplary, and weights having other configurations may well be used. In addition, while only two weights are shown, additional weights may be attached to the apparatus 10 according to the needs and abilities of the weight lifter WL.

The peripheral structure 14 includes a front member 24, a back member 26 which is spaced apart from but generally parallel to the front member 24, a first side member 28, and a second side member 30. The second side member 30 is generally spaced-apart from the first side member 28. As illustrated, the side members 28 and 30 are curvilinear. However, this shape is only illustrative and is not intended to be limiting, as the side members 28 and 30 could as well be straight. Regardless of the shapes of the members 28 and 30 (and 24 and 26 as well), it is desirable that the peripheral structure 14 generally defines a box or a closure of a similar configuration. Preferably, the peripheral structure 14 is composed of a rigid metal, although a high-tensile strength rigid plastic (preferably fiber-reinforced) may be usable in the alternative.

The shoulder rests 16 allow the user to position the apparatus on his shoulders with some degree of comfort and security. As illustrated in FIG. 1, the shoulder rests 16, in conjunction with portions of the front member 24 and the back member 26, define a central opening 31 which is sufficiently large so as to allow passage therethrough of the head of the weight lifter WL. The shoulder rests 16 extend between the front member 24 and the back member 26 and connect these members. Also as illustrated, the shoulder rests 16 are situated roughly parallel to each other.

Figure 3:
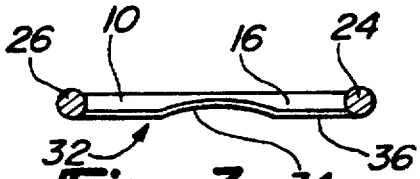
FIG. 3 is a cross-sectional view of the weight lifting apparatus taken along line 3—3 of FIG. 1.

A cross-section of the apparatus 10 (partially one of the shoulder rests 16) is shown in FIG. 3. This view generally shows the relationship between the rest 16 and the front and back members 24, 26 respectively. The rest 16 includes an underside 32 which, when the apparatus 10 is in use, is positioned on the top of the shoulder of the weight lifter WL. To assure the user that the rest 16 is properly positioned on top of his shoulder, the underside 32 may include a recessed area 34 formed thereon. To further enhance the utility of the apparatus 10, a pad 36 may be fitted to the underside 32 of the individual shoulder rest 16.

The pad 36 may be composed of an open-celled elastomeric material or may be composed of cloth- or vinyl-covered padding. Like the peripheral structure 14, the shoulder rests 16 are preferably composed of a metal, but may be composed of a high-tensile strength rigid plastic.

The coaxial hand grips 18 are positioned along the long axis LA of the frame 12. Each of the hand grips 18 includes an inner end 38 which is connected to the outer side of the shoulder rests 16 and an outer end 40 which is connected to the inner side of the approximate middle portion of the side members 28 and 30. Although not shown, the hand grips 18 preferably at least partially extend into the shoulder rests 16 for improved integrity of the apparatus 10.

Each of the hand grips 18 also preferably includes a gripping surface 42. The gripping surface 42 is formed either by selective etching of a portion of the hand grip 18 or is defined by a covering material such as a rubber or plastic sleeve. Regardless of construction, the gripping surface 42 is formed with grooves, ridges, or other elevated and recessed surfaces, thereby allowing the weight lifter WL to securely grasp the apparatus 10 without fear of slippage which would ordinarily result if a sweaty palm is used to grasp a smooth surface.

Finally, the coaxial free weight supporting lateral bars 20 define cantilevered extensions. Each of the lateral bars includes a connecting end 44 which is connected to the approximate middle of the outer side of the side members 28 and 30, thus causing the bars to extend outwardly from the outer side of each of the side members 28 and 30.

As is known in the art of free weight lifting, the weights 22 are fitted over the free ends of the lateral bars 20 and are held in place thereon by a pair of releasable locking collars 46.

The lateral bars 20 may or may not be continuous with the coaxial hand grips 18. Whether continuous or independent, the lateral bars 20 and the hand grips 18 may be of hollow or solid construction and, as with the frame 12 and the shoulder rests 16, may be composed of either a metal or a fiber-reinforced polymerized material.

In use, the weight lifter WL first selects the appropriate size and mass weights. He then fits the selected weights 22 on the lateral bars 20 and locks the weights 22 in place by use of the collars 46. The weight lifter WL then grasps the gripping surfaces 42 formed on the hand grips 18 and lifts the apparatus 10 above his head. He thereafter positions the central opening 31 (shown in FIG. 1 ) defined between the shoulder rests 16, the front member 24 and the back member 26 over his head and lowers the apparatus 10 such that his head passes into the opening 31. The weight lifter WL continues lowering the apparatus 10 until the undersides 32 of the shoulder rests 16 rest upon the tops of his shoulders. Once positioned and balanced, the weight lifter WL is able to begin his selected exercise repetitions.

Having described my invention, however, many modifications thereto will become apparatus to those skilled in the art to which it pertains. For example, the attachment points for the hand grips 18 and the lateral bars 20 may be altered. Accordingly, other modifications can be made without deviation from the spirit of the invention as defined by the scope of the appended claims.

I claim:

1. A weight lifting apparatus for use by a weight lifter for weight training through attachment to a resistive force, the apparatus comprising:

a frame including a front member and a back member;

a first shoulder rest and a second shoulder rest, said first and second shoulder rests being spaced apart and defining a pair of shoulder rests, each of said shoulder rests having an underside, each of said undersides having a concavity defined therein, said pair of spaced-apart shoulder rests connecting said front and back members, said front member, said back member, and said shoulder rests defining an enclosed space, wherein the top sides of the weight lifter's shoulders may be nested within said concavities when the weight lifting apparatus is in use; and means formed on said frame for receiving the resistive force, said front member defining a first plane, said back member defining a second plane, said first shoulder rest defining a third plane, and said second shoulder rest defining a fourth plane, said first, second, third, and fourth planes being substantially coplanar.

2. The weight lifting apparatus of claim 1, wherein said enclosed space is configured such that the head of the weight lifter may be passed therethrough.

3. The weight lifting apparatus of claim 1, further including a pair of spaced-apart hand grips attached between said shoulder rests and said frame.

4. The weight lifting apparatus of claim 3, wherein each of said grips defines an axis, said pair if spaced-apart hand grips being coaxial.

5. The weight lifting apparatus of claim 3, wherein said frame further includes a pair of spaced-apart side members and wherein said pair of spaced-apart hand grips are fitted between said pair of spaced-apart side members and said shoulder rests.

6. The weight lifting apparatus of claim 5, further including at least two free weights comprising the resistive force and a pair of cantilevered lateral bars extending from said frame, said pair of cantilevered lateral bars comprising said receiving means, one of said at least two free weights being attachable to one of said pair of cantilevered lateral bars.

7. The weight lifting apparatus of claim 6, wherein said lateral bars are coaxial with said spaced-apart hand grips.

8. The weight lifting apparatus of claim 1, wherein said front member is substantially parallel to said back member and said shoulder rests are substantially parallel.

9. The weight lifting apparatus of claim 1, wherein each of said shoulder rests includes an underside having a recessed area formed therein for substantially mating with the curved contour of the top side of the weight lifter's shoulder.

10. A weight lifting apparatus for use by a weight lifter in weight training, the apparatus comprising:

a frame including a first end, a second end, a front member, and a back member, said frame including a peripheral structure, said peripheral structure substantially defining a box;

a first hand grip attached to said first end of said frame for grasping by the weight lifter, said first hand grip defining a first axis;

a second hand grip attached to said second end of said frame for grasping by the weight lifter, said second hand grip defining a second axis, said first and second hand grips being spaced-apart, said first and second axes being coaxial;

a first shoulder rest and a second shoulder rest, said second shoulder rest being spaced apart from said first shoulder rest, said shoulder rests connected directly to said front and back members, said first hand grip connected directly to said first end and said first shoulder rest, and said second hand grip connected directly to said second end and said second shoulder rest.

11. The weight lifting apparatus of claim 10, wherein said frame further includes a front member and a back member and the apparatus further includes a pair of spaced-apart shoulder rests fitted between said front member and said back member.

* * * * *